US006717554B1

(12) United States Patent
Ming

(10) Patent No.: US 6,717,554 B1
(45) Date of Patent: Apr. 6, 2004

(54) DUAL-BAND DUAL-POLARIZATION ANTENNA

(75) Inventor: Deng Sheng Ming, Hsinchu (TW)

(73) Assignee: Inpaq Technology Co., Ltd., Hsinchu (TW)

( * ) Notice: Subject to any disclaimer, the term of this patent is extended or adjusted under 35 U.S.C. 154(b) by 0 days.

(21) Appl. No.: 10/261,688

(22) Filed: Oct. 2, 2002

(51) Int. Cl.[7] ..... H01Q 9/16
(52) U.S. Cl. ..... 343/792; 343/791
(58) Field of Search ..... 343/791, 792, 343/790, 830

(56) References Cited

U.S. PATENT DOCUMENTS 4,410,893 A * 10/1983 Griffee ..... 343/792
4,730,195 A * 3/1988 Phillips et al. ..... 343/792
6,377,226 B1 * 4/2002 Ha et al. ..... 343/791
6,552,692 B1 * 4/2003 Zeilinger et al. ..... 343/792

* cited by examiner

*Primary Examiner*—Hoang V. Nguyen
(74) *Attorney, Agent, or Firm*—Troxell Law Office PLLC

(57) ABSTRACT

A substance structure of a dual-band dipole antenna, it consists of: an internal conductor, which is formed by a lead coated with an internal insulation layer; an external conductor, which is formed by a grounding layer coated or coiled to the said internal insulation layer, and an external insulation layer coated to the grounding layer; and a metal tube with a tip connected with the external conductor; thus, by means of the exposed end section of the internal conductor that is diverged into two branches, a dual-band dipole antenna is accomplished.

2 Claims, 4 Drawing Sheets

DUAL-BAND DUAL-POLARIZATION ANTENNA

BACKGROUND OF THE INVENTION

1. Field of the Invention

The present invention relates to a substance structure of a dual-band dipole antenna, especially to a substance structure of a dual-band dipole antenna having two internal conductors diverged from the lead of the exposed end thereof, thus an effect of dual-band dipole can be accomplished.

2. Description of the Prior Art

The present invention relates to a substance structure of a dual-band dipole antenna. Presently, the substance structure of the antenna devices for signal-transmission of the point-to-point or the point-to-points wireless area network is shown in FIG. 1. It consists of an internal conductor 100 having a lead 101 coated with an internal insulation layer 102, a grounding layer 201 coated or coiled at outside the internal insulation layer 102, an external conductor 200 coated to the outside of the grounding layer 201, a layer of electric-conductive material, and a metal tube 300 having an end connected with the grounding layer 201 of the external conductor 200; the end of the substance of the antenna device is connected to a grounding terminal 400.

The conventional antenna device for signal-transmission of a wireless area network as described above, although the length and the volume thereof are reduced substantially, it just can be of single-band use, and it is not conformed to the demands with regard to the present users indeed. Although the industries are devoted to improve the single-band antenna to be a dual-band antenna, they failed usually.

The present invention is generated finally after being analyzed and tested repeatedly by the inventor of the present invention who focused on the above-mentioned conventional antenna device that is not conformed to the practical demands and the awkward situation of improving single-band antenna to be a dual-band antenna.

SUMMARY OF THE INVENTION

Accordingly, it is an object of the present invention to provide a substance structure of a dual-band dipole antenna, which enables the antenna for the point-to-point or the point-to-points wireless area network to become a dual-band dipole antenna, thus the signal-transmitting and signal-receiving field can be broadened substantially conforming to the practical demands of the users.

The present invention will be better understood and its numerous objects and advantages will become apparent to those skilled in the art by referencing to the following drawings.

DETAILED DESCRIPTION OF THE PREFERRED EMBODIMENT

Figure 1:
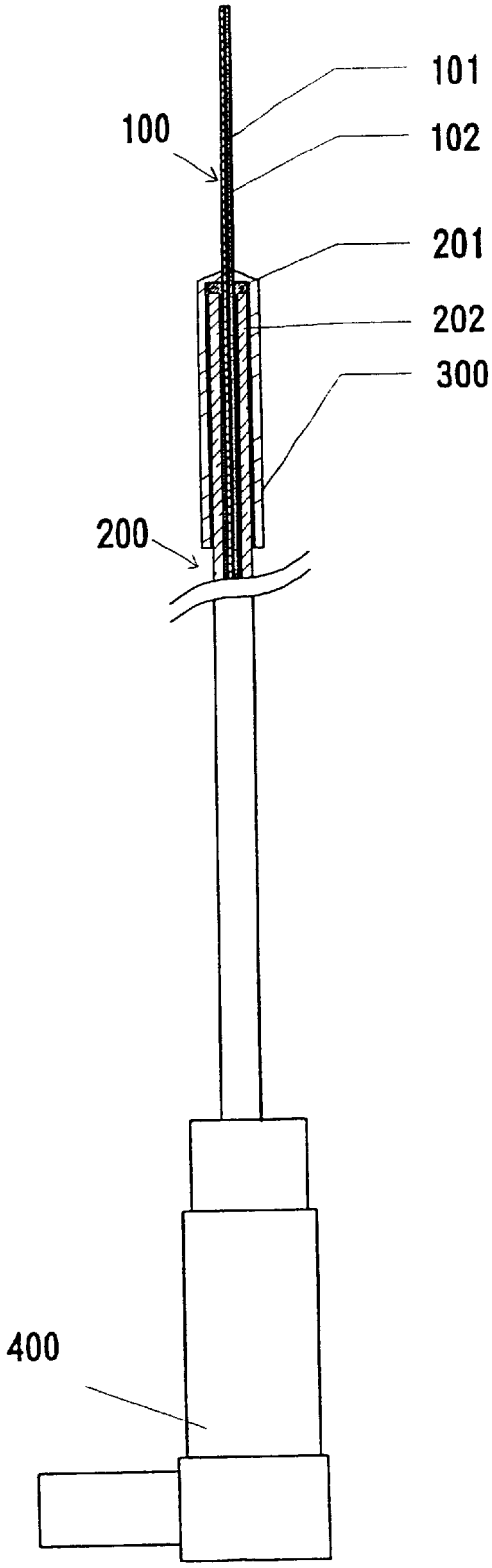
FIG. 1 is a perspective view showing a substance structure of a conventional antenna device for signal transmission of the point-to-point or the point-to-points wireless area network.

FIG. 1 is a perspective view showing a substance structure of a conventional antenna device for signal transmission of the point-to-point or the point-to-points wireless area network, and the constitution and the disadvantages thereof are already described, so they are not repeated here.

Figure 2:
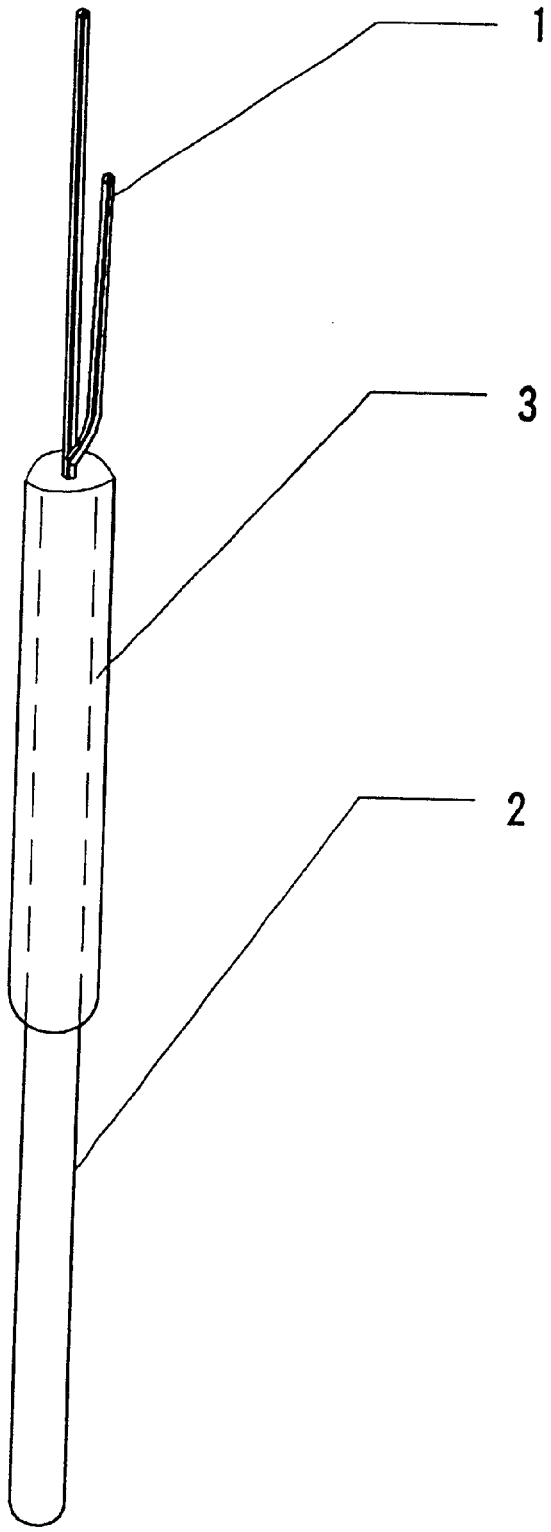
FIG. 2 is a perspective view showing the substance structure of the dual-band dipole antenna according to the present invention.
Figure 3:
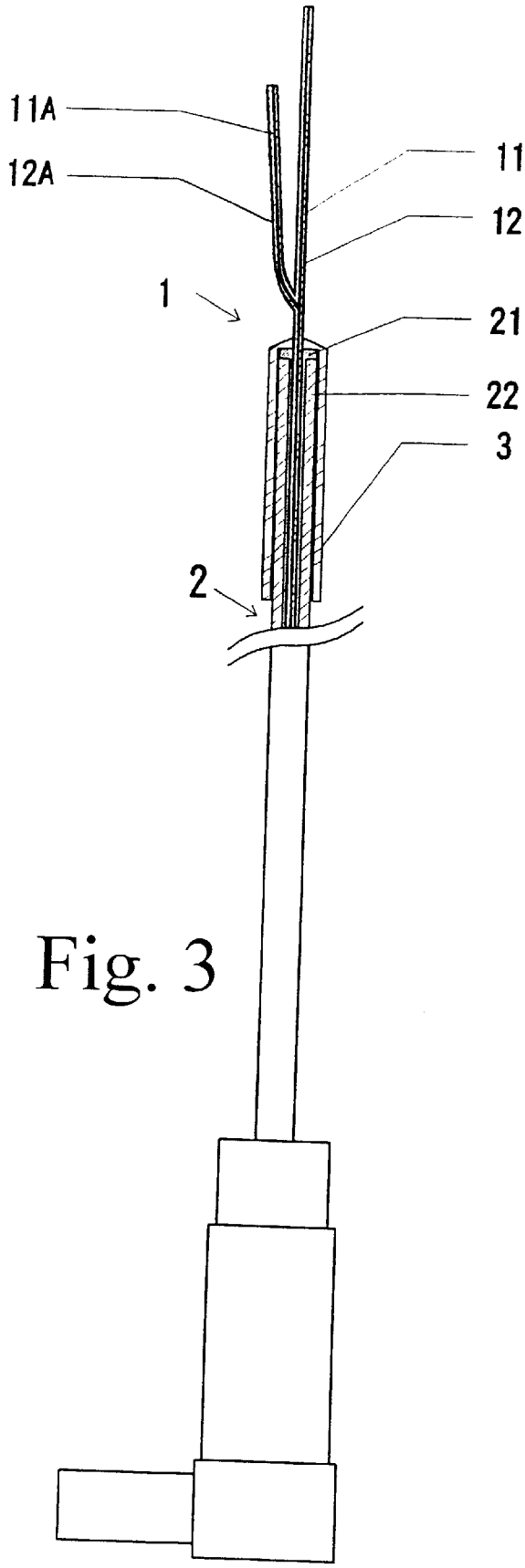
FIG. 3 is a vertical cross-sectional view showing the substance structure of the dual-band dipole antenna according to the present invention.

FIG. 2 is an entirety 3D view showing the first example of the present invention, and FIG. 3 is a vertical cross-sectional view showing the substance structure according to the first example of the present invention. It is known from the figures that the present invention comprises an internal conductor 1, an external conductor 2 and a metal tube 3. Wherein, the internal conductor 1 is located at the inmost layer, of which the center is a lead 11 coated with an internal insulation layer 12 for protection. The external conductor 2 is coated over the periphery of the internal conductor 1, and only a section of the internal conductor 1 is exposed. The external conductor 2 is made of electric-conductive material, and is coated or coiled to the grounding layer 21 outside the said internal insulation layer, and is coated to the protective external insulation layer 22 that is coated outside the grounding layer 21. The metal tube 3 is a tube made of metal set to the upper end of the external conductor 2, and the upper tip thereof is connected with top of the grounding layer 21 of the external conductor 2, thus an interconnection state is formed. The lead 11 of the internal conductor 1 is diverged to be two branches, whereon one of the branches 1A can be further coated with a protective insulation layer 12A.

Figure 4:
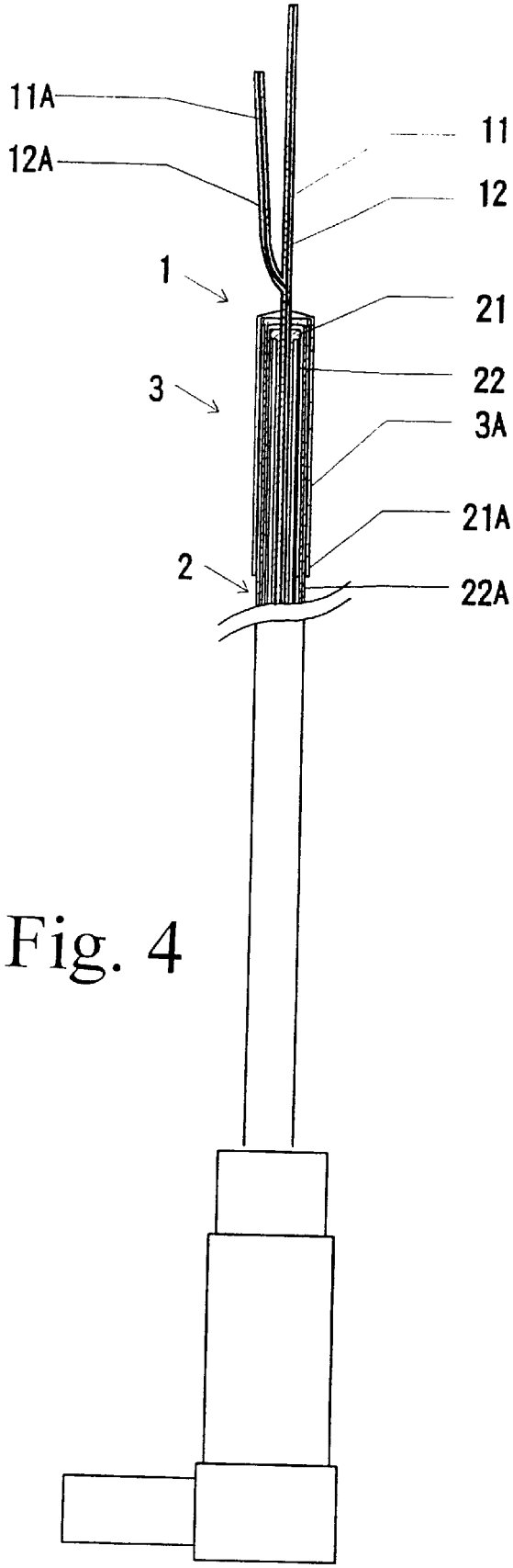
FIG. 4 shows another example of the present invention.

Since the present invention is provided with an internal conductor 1 having a diverged lead 11, the antenna device is enabled to be dual-band operated. In order to enhanced the capability thereof, as shown in FIG. 4, the external conductor is divided into two layers 2 and 2A that are coated with each other, the metal tube is also divided into two tubes 3 and 3A that are looped over each other, and the upper tip of the two metal tubes 3 and 3A are respectively connected with the top of grounding layers 21 and 21A of different external conductors.

As described above, the substance structure of the dual-band dipole antenna according to the present invention enables a dual-band signal transmission for an area network, which is unable to be accomplished at the prior conventional arts.

Although the present invention has been described using specified embodiment, the examples are meant to be illustrative and not restrictive. It is clear that many other variations would be possible without departing from the basic approach, demonstrated in the present invention.

What is claimed is:

1. A substance structure of a dual-band dipole antenna, consists of: an internal conductor, which is formed by a lead coated with an internal insulation layer; an external conductor, which is formed by a grounding layer coated or coiled to the said internal insulation layer, and an external insulation layer coated to the grounding layer; and a metal tube with a tip connected with the external conductor; thus, a dual-band dipole antenna is accomplished by means of the exposed end section of the internal conductor that is diverged into two branches.

2. The substance structure of a dual-band dipole antenna as claimed in claim 1, wherein the external conductor is formed to be two groups of grounding layers and insulation layers that are covered with each other, and the metal tube is formed to be two tubes that are looped around each other, and the upper tips of the two metal tubes are respectively connected with the grounding layer of the different external conductors.

* * * * *